US009163605B2

(12) United States Patent
Sackmann et al.

(10) Patent No.: US 9,163,605 B2
(45) Date of Patent: Oct. 20, 2015

(54) METHOD FOR CLOSED-LOOP CONTROL OF THE TEMPERATURE OF A GLOW PLUG

(71) Applicant: BorgWarner BERU Systems GmbH, Ludwigsburg (DE)

(72) Inventors: Martin Sackmann, Benningen (DE); Ramita Suteekarn, Ludwigsburg (DE); Bernd Last, Reutlingen (DE); Michael Eberhardt, Neckargemünd (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 333 days.

(21) Appl. No.: 13/785,647

(22) Filed: Mar. 5, 2013

(65) Prior Publication Data

US 2013/0233272 A1 Sep. 12, 2013

(30) Foreign Application Priority Data

Mar. 9, 2012 (DE) ..... 10 2012 102 013

(51) Int. Cl.

| | |
|---|---|
| ***F02P 19/02*** | (2006.01) |
| ***F23Q 7/00*** | (2006.01) |
| ***H05B 1/02*** | (2006.01) |
| *F02D 41/20* | (2006.01) |

(52) U.S. Cl.

CPC ..... *F02P 19/02* (2013.01); *F02P 19/022* (2013.01); *F02P 19/025* (2013.01); *F23Q 7/001* (2013.01); *H05B 1/0236* (2013.01); *F02D 2041/2027* (2013.01)

(58) Field of Classification Search

CPC ..... F02P 19/02; F02P 19/025; F02P 19/027; F02P 19/023; Y02T 10/126

USPC ..... 123/179.6, 179.21; 219/482, 483, 59.1, 219/200, 202, 205, 209

See application file for complete search history.

(56) References Cited

U.S. PATENT DOCUMENTS

| | | | | |
|---|---|---|---|---|
| 4,669,430 | A * | 6/1987 | Reinold et al. | 123/179.6 |
| 6,148,258 | A * | 11/2000 | Boisvert et al. | 701/99 |
| 7,234,430 | B2 * | 6/2007 | Toedter et al. | 123/179.6 |

(Continued)

FOREIGN PATENT DOCUMENTS

| | | |
|---|---|---|
| DE | 10 2006 010 194 A1 | 3/2007 |
| DE | 10 2006 060 632 A1 | 6/2008 |

(Continued)

*Primary Examiner* — Hai Huynh
*Assistant Examiner* — Raza Najmuddin
(74) *Attorney, Agent, or Firm* — Bose McKinney & Evans LLP

(57) ABSTRACT

A method for controlling the surface temperature of any glow plug in an internal combustion engine. A glow plug control device carries out an initialization at the installed and connected glow plug to adapt the temperature model to the behavior of the connected glow plug before the engine is started. Upon initialization, the glow plug is acted on by at least two different voltages and the resistances of the glow plug with these voltages are measured. A resistance gradient is calculated therefrom and the temperature model is adapted to the behavior of the connected glow plug. During the control process during operation of the engine, the momentary surface temperature of the glow plug is estimated by a model temperature, which is established using the temperature model. The effective voltage acting on the glow plug is changed in accordance with the deviation of the model temperature from a target temperature.

11 Claims, 1 Drawing Sheet

(56) References Cited

U.S. PATENT DOCUMENTS

| | | | | |
|---|---|---|---|---|
| 7,631,625 | B2 * | 12/2009 | De Pottey | 123/179.21 |
| 8,115,144 | B2 * | 2/2012 | Cassani et al. | 219/497 |
| 8,847,118 | B2 * | 9/2014 | Sakurai et al. | 219/263 |
| 8,976,505 | B2 * | 3/2015 | Kernwein et al. | 361/264 |
| 2007/0056545 | A1 * | 3/2007 | Kernwein et al. | 123/145 A |
| 2008/0319631 | A1 | 12/2008 | Kernwein et al. | |
| 2010/0161150 | A1 * | 6/2010 | Sakurai et al. | 700/296 |
| 2011/0000901 | A1 * | 1/2011 | Bauer et al. | 219/494 |
| 2011/0220073 | A1 | 9/2011 | Sackmann et al. | |
| 2013/0233844 | A1 * | 9/2013 | Sackmann | 219/263 |
| 2014/0054279 | A1 * | 2/2014 | Joos et al. | 219/264 |
| 2014/0126605 | A1 * | 5/2014 | Kappelmann | 374/1 |

FOREIGN PATENT DOCUMENTS

| | | | |
|---|---|---|---|
| DE | 10 2008 040 971 | A1 | 2/2010 |
| DE | 10 2010 011 044 | A1 | 9/2011 |
| GB | 2472811 | A | 2/2011 |

* cited by examiner

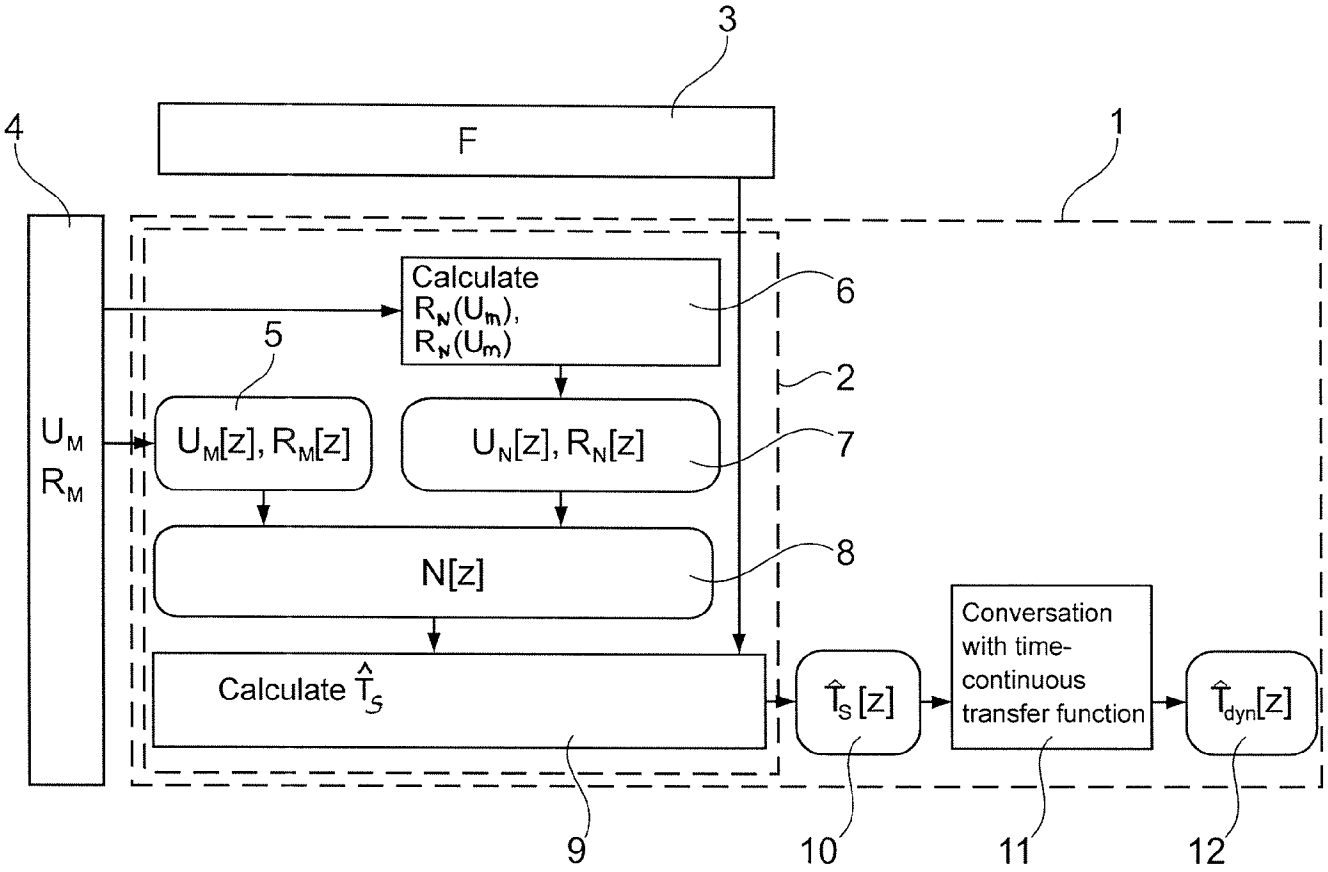
1
2
3
F
4
$U_M$
$R_M$
5
$U_M[z], R_M[z]$
6
Calculate $R_N(U_m)$, $R_N(U_m)$
7
$U_N[z], R_N[z]$
8
N[z]
9
Calculate $\hat{T}_S$
10
$\hat{T}_S[z]$
11
Conversation with time-continuous transfer function
12
$\hat{T}_{dyn}[z]$

METHOD FOR CLOSED-LOOP CONTROL OF THE TEMPERATURE OF A GLOW PLUG

RELATED APPLICATIONS

This application claims priority to DE 10 2012 102 013.2, filed Mar. 9, 2012 which is hereby incorporated by reference in its entirety.

BACKGROUND

This disclosure relates to a method for closed-loop control of the surface temperature of any glow plug from a specific series in an internal combustion engine, using a glow plug control device that acts on the glow plug connected thereto with a pulse-width-modulated effective voltage and in which a temperature model displaying the behaviour of the series is stored.

A method of this type is known from German Publication No. DE 10 2006 060 632, in which the temperature model is fed with parameters of the glow plug and other operating variables. A model temperature is established in accordance with these input variables and corresponds to the surface temperature of the glow plug. A target resistance for the glow plug is established from the deviation of the model temperature from a target temperature and the current resistance of the glow plug is controlled to the target resistance by a control system.

German Publication No. DE 10 2008 040 971 A1 describes a method of the type mentioned in the introduction in order to correct a base control of the glow plug, which is carried out with an effective voltage established from a characteristic map. The temperature model calculates a model temperature of the glow plug from the resistance measured at the glow plug. This model temperature is then compared with the target temperature. The effective voltage established from the characteristic map is adapted accordingly on the basis of the deviation.

A closed-loop control method is known from U.S. Publication No. 2011/0220073, in which the control is likewise based on the assignment of a temperature to an electrical resistance. To improve the control it is proposed to measure the combustion chamber pressure using a pressure sensor of the glow plug and to use this for correction of the resistance expected for the target value of the surface temperature of the glow plug in order to take into account approximately the cooling or heating effect of combustion gases.

The quality of the temperature control achieved with the known methods is poor, however. This is true in particular for ceramic glow plugs, with which there are strong variations of the cold resistance as a result of the manufacturing process. An unambiguous assignment of a temperature to a measured resistance is then not possible. Moreover, the prediction of the behaviour of the hot glow plug on the basis of the cold resistance is also largely unfeasible in known methods.

Accordingly, a way in which the surface temperature of a glow plug can be controlled more precisely is desirable.

SUMMARY

In one embodiment, the glow plug control device carries out an initialization at the glow plug that is installed and connected ready for use. In this initialization the temperature model is adapted, which is stored in the glow plug control device for the series to which the connected glow plug belongs, to the behaviour of the connected glow plug before the internal combustion engine is started. With the initialization step, any deviations of the connected glow plug from an ideal glow plug of the series are found and the temperature model designed for an ideal glow plug in the series is adapted on the basis of the deviations of the connected glow plug.

Series are sometimes also referred to as classes, types or models. A series is to be understood to mean glow plugs that differ from one another merely by deviations within production tolerances. Ideally, all glow plugs in a series should thus match in terms of all properties and dimensions. Manufacturing tolerances are unavoidable however, which is why glow plugs in a series differ within the scope of manufacturing tolerances. This is true in particular for the cold resistance of ceramic glow plugs, which are subject to considerable fluctuations as a result of the manufacturing process.

Before the internal combustion engine is started for the first time, the glow plug control device carries out an initialization at the installed and connected glow plug ready for use in order to adapt the temperature model to the behaviour of the connected glow plug. Such an initialization is also necessary if a new glow plug is inserted, for example when servicing the internal combustion engine. If ageing processes of the glow plug are suspected, which change the behaviour of the connected glow plug, it is possible to repeat the initialization at certain time intervals, even if the glow plug is not changed.

During the initialization process, glow plug specific internal influences, that is to say the manufacturing tolerances of the glow plug, are determined at the glow plug. To this end, at least two different voltages are applied to the glow plug. The resistances of the glow plug with these voltages are then measured. Two actual values for voltage U and resistance R of the connected glow plug are thus measured in each case.

Depending on the embodiment of the glow plug control device, it may be that voltage and resistance are not measured directly by the glow plug control device. For example, the values can be measured in another way and provided to the glow plug control device. Instead of the resistance R, the current I flowing through the glow plug may also be measured. The resistance can then be calculated from the relationship R=U/I. Only two of the three variables current, voltage and resistance therefore have to be measured directly at the connected glow plug, the third variable then being provided by simple conversion. For reasons of linguistic clarity, only the measured values of voltage and resistance will be mentioned within the scope of this application. A measured value is also a converted value, however, which is calculated from two other measured variables using the above relationship. A "measured resistance" of the glow plug is therefore also a resistance calculated from the momentary voltage and the measured current.

During initialization, the glow plug is supplied with a first voltage during stoppage of the internal combustion engine. For example, this voltage may be a nominal voltage of the glow plug, at which it is to reach its nominal temperature of 1200° C. The nominal voltage may be 5 volt, 6 volt or 7 volt, for example, or anything in between, depending on the series and glow plug producer. Preferably, this voltage is applied to the glow plug until it has reached its static temperature. Manufacturing tolerances mean that a temperature deviating slightly from the nominal temperature is established upon application of the nominal voltage. The resistance $R_{J1}$ of the hot glow plug with this first voltage is then measured. This procedure is then repeated with a second voltage, which differs from the first voltage, for example by about 1 to 2 volt. The two resistances and the two voltages form two value pairs comprising measured values of voltage and resistance. A difference quotient is calculated from the two value pairs and will be referred to hereinafter as a resistance gradient $g_R$. The difference between the two measured resistances is thus divided by the difference between the measured voltages for the resistance gradient $g_R$.

If, during initialization, the static temperature is given time to become established once a voltage has been applied to the glow plug and the resistance is only then measured, the initialization indeed has a very good level of accuracy, but requires a relatively long period of time, which may lie within the range from one to two minutes. It may therefore be advantageous not to wait until the static state has been reached to measure the resistance. In such a case, a prediction model can be used, with which it is possible to determine the static end value of the resistance. The resistance measurements can then be taken shortly after application of the voltage or shortly after a voltage change and can be converted with the aid of the prediction model to resistance values that would arise in the static state. In the simplest case, an extrapolation of measured values can be carried out as a prediction model. In addition, it can be taken into account that the measured values approximate an equilibrium value exponentially with behaviour typical for heating processes. Such a prediction model can be designed such that the loss of accuracy is practically irrelevant, but the initialization can be completed much more quickly. This shortening of the initialization in particular allows the initialization to be repeated in certain time intervals before engine start-up in order to check the glow plugs, for example for signs of ageing.

The temperature model is then adapted by means of one of the resistances measured at the glow plug supplied with voltage, preferably by means of $R_{f1}$, and by means of the resistance gradient $g_R$. Due to this adaptation of the temperature model, the manufacturing tolerances specific behaviour of the glow plug connected to the control device can be taken into account during the temperature control process. The use of the resistance gradient in the adaptation process has the considerable advantage that the behaviour of the connected glow plug, which is deviating from the expected behaviour of the series on account of manufacturing tolerances, can thus be predetermined very precisely. The problem of the prior art mentioned in the introduction, that is to say the fact that the cold resistance has such large variations that it is no longer possible to definitively assign a temperature to a measured resistance, can no longer have a detrimental effect. On the one hand it is not the cold resistance, but a resistance value of the hot glow plug that is used for adaptation. On the other hand, the resistance gradient has been found to be a reliable variable, which in particular enables a precise adaptation of the temperature model, even with ceramic glow plugs.

The glow plug-specific influencing variables used for adaptation of the temperature model are thus at least one of the measured resistances and the resistance gradient. A glow plug-specific reference vector F where $F \epsilon R^{1xQ}$ can thus be formed from the glow plug-specific influencing variables, wherein Q is the number of glow plug-specific influencing variables and is at least two in this case. The glow plug-specific reference vector F thus comprises at least one of the measured resistances and the resistance gradient. It is stored in the glow plug control device and is used to adapt the temperature model to the behaviour of the connected glow plug during the control process during operation. The initialization is thus finished.

During initialization, the temperature model is additionally adapted to the behaviour of the connected glow plug by means of the reciprocal of the resistance gradient $g_R$. Thereby the adaptation of the temperature model to the manufacturing deviations of the connected glow plug is improved and the accuracy of the temperature control is increased further. The preferred glow plug-specific reference vector F is thus $$F=[R_{f1} g_R 1/g_R]$$

With the method according to this disclosure, during the control process during operation of the internal combustion engine, the momentary surface temperature of the glow plug is estimated by a model temperature, which is established with the aid of the adapted temperature model from the actual values of voltage and of resistance measured at the glow plug during operation. To control the surface temperature, the effective voltage applied to the glow plug is then changed in accordance with the deviation of the model temperature from a target temperature of the glow plug surface. The glow plug target temperature for the glow plug surface can be provided to the glow plug control device for example by an engine control device.

The method according to this disclosure has the advantage that the surface temperature can be controlled much more accurately than with the known methods. The surface temperature can be controlled up to an accuracy of ±40° C. At the same time, the method according to this disclosure is still so simple that it can be carried out without difficulty in real time in a glow plug control device with limited processing capacity.

With the method according to this disclosure, only the actual values of voltage and resistance measured at the glow plug are used as input variables during the control process during running operation. Other operating variables of the engine, for example speed of rotation or torque, do not need to be provided to the glow plug control device, since they are not necessary for the present temperature model.

To establish the temperature model, the behaviour of a reference group of a plurality of glow plugs in the series is determined in a prior process. When measuring the behaviour of the reference group, each of the glow plugs in the reference group operated with different voltages, both and without the influence of external disturbances. The resistance and the surface temperature are measured with each voltage and a plurality of model coefficients for the temperature model is established from the measured data, in particular, by a least-square estimation. This can be achieved by taking measurements at actual, existing glow plugs, for example, under static conditions in an engine or a test stand. The test stand may generate an engine-like environment for example for the glow plug, or other defined environmental conditions. Here, it is advantageous if the glow plugs on the test stand are subject to a defined gas flow and the flow speeds can be changed in order to simulate different external interfering influences. It is also possible however for the model coefficients to be established by corresponding simulation calculations, as are to be expected under consideration of manufacturing tolerances for the series.

To increase the robustness of the temperature model and to take into account in the temperature model external disturbances currently present at the glow plug, it is advantageous if at first an expected temperature of the glow plug without external disturbances is calculated. Furthermore, it is preferable if at least one indicator for external disturbances is calculated. The model temperature of the glow plug is then calculated from the expected temperature of the glow plug without external disturbance and from the indicator for external disturbances, in particular, by an addition with an addend derived from the indicator. In order to achieve an optimal adaptation of the temperature model, both the expected temperature of the glow plug without external disturbances and the indicator for external disturbances are preferably adapted to the behaviour of the connected glow plug at least by means of one of the resistances measured during initialization and the resistance gradient established during initialization.

It is advantageous if a plurality of indicators for external disturbances is used in the temperature model in order to achieve sufficient accuracy. It is preferable for at least one auxiliary variable to be calculated in the temperature model from measured actual values of voltage and of resistance and for this auxiliary variable to be used when determining the at least one indicator for external disturbances. One of the preferred auxiliary variables is an actual glow plug current, which is established from the measured values of voltage and of resistance, if this has not already been measured directly. A further preferred auxiliary variable is a nominal resistance, which is characteristic for the series at the measured voltage without external disturbing influences. A further preferred auxiliary variable is a nominal voltage, which is characteristic for the series at the measured resistance without external disturbing influences.

The nominal resistance $R_N$ and the nominal voltage $U_N$ may be polynomials for example, preferably of third degree, which are determined on the basis of the measured data of the reference group. Such polynomials are often also referred to as "fit functions." In the fitting process, values having the property of delivering the smallest possible deviation of function values of the fit function from the points of a data record are determined for the adaptable function parameters of the fit function values. In the present case, after adaptation of the function parameters, that is to say for the resistance values of the measured data of the reference group, the fit function is to supply voltage values deviating as little as possible from the voltage values of the reference group and vice versa. The nominal resistance is a fit function, which, for the series and for any voltage, supplies a resistance value that is typically to be expected with a glow plug in the series. The nominal voltage is a fit function that gives a typical voltage value for a series for any resistance of a glow plug.

Preferred fit functions for nominal resistance and nominal voltage are $$R_N(U)=a_{U0}+a_{U1}U+a_{U2}U^2+a_{U3}U_3$$

$$U_N(R)=a_{R0}+a_{R1}R+a_{R2}R^2+a_{R3}R^3$$

Here, U, R are the real-time measured values of voltage and resistance and $a_U$ and $a_R$ are the coefficients from the measurement of the reference group without external disturbances. The parameters $a_U$ and $a_R$ have preferably been established by least-square estimation.

In a further embodiment it is advantageous if, in the adapted temperature model, a static model temperature is first calculated from the actual values of voltage and of resistance measured at the glow plug during running operation, said static model temperature being adapted to the behaviour of the connected glow plug at least by means of one of the resistances measured during initialization and the resistance gradient established during initialization, and this static model temperature is then converted to the dynamic model temperature present in the current time period. The temperature model thus has a plurality of stages, which can be calculated in succession. As there are several stages of the temperature model, a simplification is achieved, since the individual stages of the model are less complex. The conversion is preferably carried out by means of a transfer function, which is characteristic for the dynamic behaviour of the series without external disturbing influences connected with sudden temperature changes. The transfer function is likewise established at the reference group of glow plugs by measuring the temperature changing over time for sudden temperature changes.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein:

FIG. 1 shows a schematic overview of a temperature model preferably used during the control process.

DETAILED DESCRIPTION

The embodiments described below are not intended to be exhaustive or to limit this disclosure to the precise forms disclosed in the following detailed description. Rather, the embodiments are chosen and described so that others skilled in the art may appreciate and understand the principles and practices of the present invention.

A glow plug control device, which controls the glow plugs connected to the control device, is provided on an internal combustion engine, for example in a motor vehicle, having a plurality of glow plugs. Depending on the operating state of the engine, the engine control device predefines a target temperature for the glow plugs. This is transferred by the engine control device to the glow plug control device. The glow plug control device then controls the surface temperature of a glow plug to a target temperature, which is set by the engine control device. Since the glow plug control device does not know the current actual temperature of the glow plug, it uses a temperature model. See the dashed box with reference sign 1. The glow plug control device constantly measures, via electrical sensors, the voltage $U_M$ applied to the glow plug and the resistance present of the glow plug $R_M$. The measured values $U_M$ and $R_M$ are the input variables of the temperature model 1. See box 4. The glow plug-specific reference vector F established during initialization, as described above, for adaptation of the temperature model is indicated in box 3. No further input variables, in particular other engine operating variables, are used during the closed-loop control process.

The glow plug control device operates in a clocked manner. The discrete magnitude of a time step z in the glow plug is 30.5 milliseconds for example, $U_M$ and $R_M$ are measured in each time step z and a model temperature is calculated therefrom in real time in the temperature model 1, said model temperature corresponding to the momentary surface temperature of the glow plug. The glow plug control device calculates a control deviation from the target temperature and the model temperature. A controller, for example a PI controller, in the glow plug control device generates therefrom a pulse-width-modulated effective voltage, which is applied to the connected glow plug.

The temperature model 1 is formed in a number of stages and contains a static stage (see the dashed box 2) and a subsequent dynamic stage. A static model temperature, which the glow plug would have if it had already reached its static state, is first established from the input variables. The static model temperature is then converted to the dynamic model temperature present in time step z.

During the closed-loop control process during operation of the internal combustion engine, the actual values of voltage $U_M$ and of resistance $R_M$ are measured at the glow plug in each time step z. These two values represent the actual behaviour of the connected glow plug in the temperature model. See box 5. In the FIGURE, [z] denotes the respective value at a specific discrete time step z.

In order to establish the expected behaviour of the series, a nominal resistance and a nominal voltage are calculated as auxiliary variables from the measured values. With the aid of the two above-mentioned fit functions, the nominal resistance $R_N(U_M)$ is calculated in box 6 for the voltage $U_M$ measured in the time step z. The nominal voltage $U_N(R_M)$ is calculated analogously. The nominal voltage $U_N$ and nominal resistance $R_N$ in the current time step z (see box 7) characterise the expected behaviour of a glow plug in the series in the absence of external disturbing influences.

In the temperature model, a comparison can then be made between the actual behaviour 5 and the nominal behaviour 7, and the magnitude of the external disturbances present can thus be established. To this end, a plurality of indicators for external disturbances is calculated from the values in boxes 5 and 7.

A preferred indicator is the momentary glow plug current $I_{GP}=U_M/R_M$. In addition, the nominal resistance $R_N$ is preferably also used as an indicator. The indicators can be combined to form an indicator vector N where $N \epsilon R^{Px1}$, wherein P denotes the number of individual indicators. N is consequently a vector with a column and a row corresponding to the number of indicators. The use of three indicators for external disturbances has been found to be particularly convenient. The use of the following indicator vector N has proven to be preferable $$N=[I_{GP}R_N^2/\Delta U_{GP,R}R_N]^T$$

Here, $\Delta U_{GP,R}=U_M-U_N(R_M)$, that is to say the deviation of the measured voltage from the nominal voltage.

The determination of the indicator vector N in the current time step z is indicated in the FIGURE in box 8. In box 9, the static model temperature $\hat{T}_S$ is then calculated by means of a linear function:

$$\hat{T}=\Theta_N \times N+T_o$$

wherein $T_o$ describes the expected temperature of the connected glow plug without external influences and $\Theta_N \epsilon R^{1xP}$ describes the magnitude of the influence of the external disturbances on the connected glow plug. $\Theta_N$ and $T_o$ are calculated from the glow plug-specific reference vector F and from the model parameters $\phi_\Theta$ and $\phi_{To}$. Therein the model parameters $\phi_\Theta \epsilon R^{QxP}$ and $\phi_{To} \epsilon R^{Qx1}$ have been determined from the measured data from the reference group.

$$\theta_N=F \times \phi_\theta$$

$$T_o=F \times \phi_{To}$$

The following is thus given for the static model temperature $\hat{T}_S$ $$\hat{T}_S=F \times \phi_\Theta \times N+F \times \phi_{To}$$

An expected temperature $T_o$ of the glow plug without external disturbance is thus first calculated and is adapted to the behaviour of the connected glow plug by means of the glow plug-specific reference vector F. The model temperature $\hat{T}_S$ is then calculated from $T_o$ by an addition of an addend formed from the indicator vector N, wherein the indicator vector N is likewise adapted to the behaviour of the connected glow plug by the glow plug-specific reference vector F.

The static model temperature $\hat{T}_S$ is calculated in box 9 of the static temperature model 2. The adaptation of the temperature model by the glow plug-specific influencing variables in the glow plug-specific reference vector F is illustrated by the arrow from box 3 to box 9. In box 10 the static model temperature $\hat{T}_S$ in the time step z is illustrated again as an output variable of the static temperature model.

For the aforementioned preferred indicator vector N with three indicators for external disturbances and the preferred glow plug-specific reference vector F with three influencing variables, a total of 12 model parameters for $\phi_\Theta$ and $\phi_{To}$ are thus to be established during the measurement of the glow plug reference group.

The static model temperature $\hat{T}_S$ is then converted in box 11 to the dynamic model temperature $\hat{T}_{dyn}$ present in the time step z. Therein, the following time-continuous transfer function is preferably used:

$$G(s)=\frac{K(\tau_N s+1)}{(\tau_{P1}s+1)(\tau_{P2}s+1)}$$

Here: s is a Laplace variable, K is an amplification factor and τ time constants. The time-continuous transfer function can be converted directly into a time-discrete transfer function with a known sampling time of the control process. The implementation of this time-discrete transfer function in the glow plug control device operating in a time-discrete manner can thus be carried out directly within the control process.

The time constants are established by a least-square estimation from the measured data of the reference group of the glow plug without external disturbing influences with sudden temperature changes. With a short time step size z in the glow plug control device, the external disturbing influences in the transfer function can be disregarded. The transfer function is thus characteristic for the dynamic behaviour of the series without external disturbing influences.

The transfer function and the model parameter are established in a prior step, for example, by the producer of the glow plugs. The transfer function and the model parameters are then stored once in the glow plug control device and are not changed further during the control process.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method of using a glow plug control device for closed loop control of the surface temperature of a glow plug of a specific series in an internal combustion engine, comprising:

applying a pulse-width-modulated effective voltage to the glow plug connected to the control device and storing in the control device a temperature model displaying the behavior of the series;

carrying out an initialization at the installed and connected glow plug ready for use to adapt the temperature model to the behavior of the connected glow plug before the internal combustion engine is started;

wherein, during the initialization for adaptation of the temperature model:

the glow plug is supplied with at least two different voltages and the resistances of the glow plug with these voltages are measured;

a resistance gradient is calculated as the difference between the two measured resistances divided by the difference between the two supplied voltages; and the temperature model is adapted to the behavior of the connected glow plug by using at least one of the measured resistances and the resistance gradient;

wherein, during the control process the momentary surface temperature of the glow plug is estimated by a model temperature while the engine is running, said model temperature being established with the aid of the temperature model from the actual values of voltage and of resistance measured at the glow plug during running operation; and wherein the effective voltage applied to the glow plug is changed according to the deviation of the model temperature from a target temperature of the glow plug surface provided to the glow plug control device.

2. The method according to claim 1, wherein the temperature model during initialization is additionally adapted to the behavior of the connected glow plug by means of the reciprocal of the resistance gradient.

3. The method according to claim 1, wherein external disturbing influences present at the glow plug are accounted for by:

calculating an expected temperature of the glow plug without external disturbances and at least one indicator for external disturbances in the temperature model; and calculating the model temperature of the glow plug from the expected temperature and the at least one indicator for external disturbances.

4. The method according to claim 3, wherein the model temperature of the glow plug is calculated from the expected temperature of the glow plug without external disturbances by an addition with an addend calculated from the indicator for external disturbances.

5. The method according to claim 3, wherein the expected temperature of the glow plug without external disturbances and/or the indicator for external disturbances are adapted to the behavior of the connected glow plug by means of one of the resistances measured during initialization and the resistance gradient established during initialization.

6. The method according to claim 3, wherein at least one auxiliary variable is calculated in the temperature model from measured actual values of voltage and of resistance, and wherein the auxiliary variable is used when determining the at least one indicator for external disturbances.

7. The method according to claim 6, wherein one of the auxiliary variables is an actual glow plug current, which is established from the measured values of voltage and of resistance.

8. The method according to claim 6, wherein one of the auxiliary variables is a minimal resistance, which is characteristic for the series at the measured voltage without external disturbing influences.

9. The method according to claim 6, wherein one of the auxiliary variables is a nominal voltage, which is characteristic for the series at the measured resistance without external disturbing influences.

10. The method according to claim 1, wherein in the temperature model:

a static model temperature is calculated in the temperature model from the actual values of voltage and of resistance measured at the glow plug during running operation, said model temperature being adapted to the behavior of the connected glow plug at least by means of one of the resistances measured during initialization and the resistance gradient established during initialization, and the static model temperature is then converted to the dynamic model temperature present in the current time period.

11. The method according to claim 10, wherein the conversion of the static model temperature to the dynamic model temperature is carried out by means of a transfer function, which is characteristic for the dynamic behavior of the series without external disturbing influences with sudden temperature changes.

* * * * *